US005138721A

United States Patent [19]

Spector

[11] Patent Number: 5,138,721

[45] Date of Patent: Aug. 18, 1992

[54] PNEUMATIC BOLSTER

[76] Inventor: Donald Spector, 380 Mountain Rd., Union City, N.J. 07458

[21] Appl. No.: 345,405

[22] Filed: May 1, 1989

Related U.S. Application Data

[63] Continuation-in-part of Ser. No. 205,477, Jun. 13, 1988, Pat. No. 4,834,382.

[51] Int. Cl.[5] ..... A41D 27/26

[52] U.S. Cl. ..... 2/267; 5/449; 273/65 B

[58] Field of Search ..... 2/24, 267, 268, 411, 2/413, 414, DIG. 3; 5/441, 448, 449, 470, 471, 472; 152/514, 515; 273/58 BA, 65 B

[56] References Cited

U.S. PATENT DOCUMENTS

| | | | |
|---|---|---|---|
| 496,789 | 5/1893 | Morgan | 152/514 |
| 717,229 | 12/1902 | Lott | 273/65 B |
| 1,382,831 | 6/1921 | Hilker | 5/441 |
| 2,822,554 | 2/1958 | Wenzelberger | 5/441 |
| 2,942,281 | 6/1960 | Cole | 5/441 |
| 3,426,891 | 2/1969 | Marks | 5/449 |
| 4,445,240 | 5/1984 | Voorhees | 5/441 |
| 4,507,801 | 4/1985 | Kavanagh | 2/267 |
| 4,754,511 | 7/1988 | Sargent | 5/449 |
| 4,768,247 | 9/1988 | Beier | 5/441 |
| 4,834,382 | 5/1989 | Spector | 273/58 BA |

FOREIGN PATENT DOCUMENTS

| | | | |
|---|---|---|---|
| 1061480 | 8/1979 | Canada | 5/441 |
| 65115 | 1/1914 | Fed. Rep. of Germany | 273/65 B |
| 460248 | 5/1928 | Fed. Rep. of Germany | 273/65 B |
| 572321 | 3/1933 | Fed. Rep. of Germany | 273/65 B |
| 592648 | 1/1934 | Fed. Rep. of Germany | 273/65 B |
| 2222070 | 10/1974 | France | 5/449 |
| 70143 | 3/1946 | Norway | 273/65 B |
| 8986 | of 1906 | United Kingdom | 273/65 B |

*Primary Examiner*—Werner H. Schroeder
*Assistant Examiner*—Diana L. Biefeld
*Attorney, Agent, or Firm*—Michael Ebert

[57] ABSTRACT

A pneumatic cushion or bolster adapted to function as a bumper for boats, as protective packaging and as pneumatic elements included in wearing apparel. The bolster is composed of a non-stretchable fabric casing shaped to define, when fully expanded, a bolster in a configuration appropriate to its intended use, the casing having a small, closable port therein. Inserted through the port in its unexpanded state is a rubber balloon whose stem initially projects out from the port to permit mouth inflation of the balloon to an extent causing it to engage and conform to the inner surface of the casing. The stem is then tied and pushed within the casing, after which the port is closed, thereby fully encasing the balloon to provide a bolster having pneumatic properties.

7 Claims, 2 Drawing Sheets

PNEUMATIC BOLSTER

RELATED APPLICATION

This application is a continuation-in-part of my copending application Ser. No. 205,477, filed Jun. 13, 1988, entitled "Inflatable Play Ball," (now U.S. Pat. No. 4,834,382, issued May 30, 1989) the entire disclosure of which is incorporated herein by reference.

BACKGROUND OF INVENTION

1. Field of Invention

This invention relates generally to pneumatic cushions or bolsters, and more particularly to a pneumatic bolster formed from an outer non-stretchable fabric casing enclosing an inflated rubber balloon imparting pneumatic properties to the bolster which renders it usable as a bumper for boats and the like, for protective packaging or for inclusion in wearing apparel.

2. Status of Prior Art

Pneumatic cushions are known which are formed of a heavy-duty bladder molded to assume a shape appropriate to its end use. When the bladder, whose stem is provided with a one-way valve, is inflated to an internal pressure sufficient to cause the bladder to assume its normal form, it will then have cushioning properties. Thus when a load is imposed on the pneumatic cushion, the air therein will be compressed and the cushion will yield to an extent that depends on the magnitude of the load.

A conventional pneumatic cushion formed by an inflatable bladder has two distinct drawbacks:

I. It is subject to rupture. Thus if a pneumatic cushion is placed on the flat seat of a chair and a heavy individual then sits on the cushion, the resultant increase in internal pressure will cause the sides of the bladder to bulge out. Should there be a weakness or defect in the bladder sides, such as a relatively thin region, the internal pressure exerted on this region may cause the bladder to burst.

II. Since a bladder is molded to assume a predetermined final form, when it is inflated by mouth to swell from its collapsed state to its final form, the degree of air pressure required for this purpose is low. Hence the internal pressure of the inflated bladder is low and it has relatively poor pneumatic properties, for the bladder offers little resistance to a load imposed thereon. In contradistinction, a rubber balloon in its molded form is much smaller than its inflated form, and it requires much more air pressure to inflate and stretch the rubber skin to cause the balloon to assume a desired final form which is not predetermined. Hence in an inflated rubber balloon, the internal air pressure is far greater than in an inflated bladder.

The play ball disclosed in my above-identified copending application exploits the high internal air pressure in an inflated rubber balloon, yet overcomes the inherent weakness of the balloon which is easily burst when subjected to external stress. To this end, the balloon is encased in a non-stretchable fabric casing shaped to assume the shape of a football or other play ball when fully expanded.

The fabric casing is provided with a closable port through which the balloon in its uninflated state is inserted, with its stem sticking out of the open port. Inflation of the balloon by mouth causes it to engage and conform to the inner surface of the casing, after which the stem is tied and pushed into the port. The port is then closed to fully encase the balloon, so that no portion thereof can be extruded from the casing.

As pointed out in my copending application, an unencased rubber balloon has little strength; for by applying external pressure to one region thereof, the unstressed region is caused to stretch to its bursting point. But when the inflated balloon is fully encased in a non-stretchable fabric casing, even though the balloon, per se, is inherently weak, because of the casing does not permit any region of the balloon to further expand beyond its existing degree of expansion, the ball will not burst even if a heavy adult sits on the ball.

The reason the encased rubber balloon ball has high bounce characteristics is that its internal air pressure is much higher than, say, a conventional beach ball made of a non-stretchable plastic film. With a conventional beach ball, it takes little pressure to blow it up, for the plastic sphere offers little resistance to expansion until it is fully inflated, at which point since the material is non-stretchable, it cannot be further inflated. But with a stretchable rubber balloon, it takes much more air pressure to stretch the rubber from its initial state to its stretched and inflated state, as a consequence of which the internal air pressure is much higher than in a conventional beach ball.

While the present invention relates to a pneumatic bolster, not to a play ball, it exploits the strength and bounce characteristics of a play ball of the type disclosed in my copending patent application to provide a bolster having exceptional cushioning or protective characteristics.

Of prior art interest is the patent to Tillotson et al., U.S. Pat. No. 4,758,199, which discloses an imitation toy hot air balloon having a nylon outer envelope provided at its bottom with a circular opening to which a cylindrical skirt is attached, a gondola being suspended by wires from the skirt. Housed within the nylon envelope is an inflated latex balloon. But this balloon, whose function is to cause the envelope to assume its desired shape, is not fully enclosed by the envelope, and it is therefore not capable of withstanding heavy external pressures.

SUMMARY OF INVENTION

In view of the foregoing, the main object of this invention is to provide pneumatic cushions or bolsters whose shapes are appropriate to their intended use, the bolsters being: of high strength and having exceptional cushioning or protective characteristics.

More particularly, an object of this invention is to provide bolsters of the above type formed of an outer non-stretchable fabric casing which fully encases a conventional inflatable latex or rubber balloon.

A significant advantage of the invention is that the bolsters, when not in use, can be collapsed into a highly compact form.

Also an object of the invention is to provide pneumatic bolsters which may be manufactured at low cost and are adapted to function as a bumper for boats and for many other applications requiring protective bumpers.

Briefly stated these objects are attained in a pneumatic cushion or bolster adapted to function as a bumper for boats, as protective packaging and as pneumatic elements included in wearing apparel. The bolster is composed of a non-stretchable fabric casing shaped to define, when fully expanded, a bolster in a configuration appropriate to its intended use, the casing having a small, closable port therein. Inserted through the port in its unexpanded state is a rubber balloon whose stem initially projects out from the port to permit mouth inflation of the balloon to an extent causing it to engage and conform to the inner surface of the casing. The stem is then tied and pushed within the casing, after which the port is closed, thereby fully encasing the balloon to provide a bolster having pneumatic properties.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Bolsters

Figure 1:
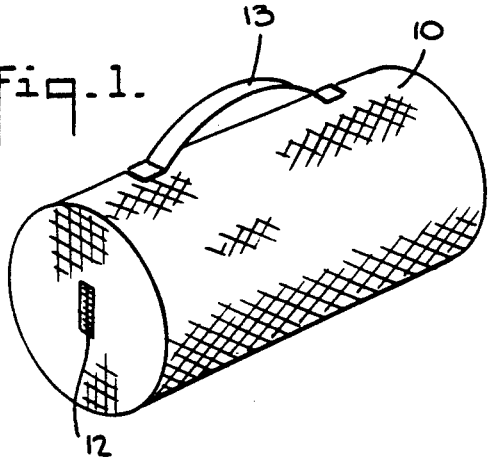
FIG. 1 is a perspective view of a pneumatic bolster in accordance with the invention.
Figure 2:
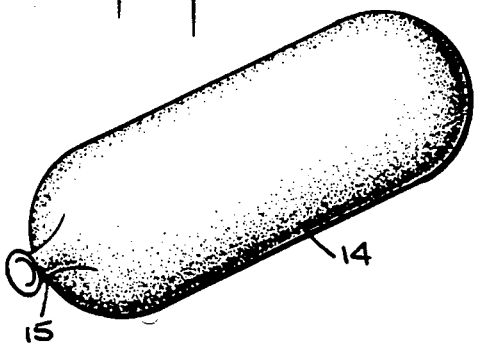
FIG. 2 is a longitudinal section taken through the bolster.
Figure 3:
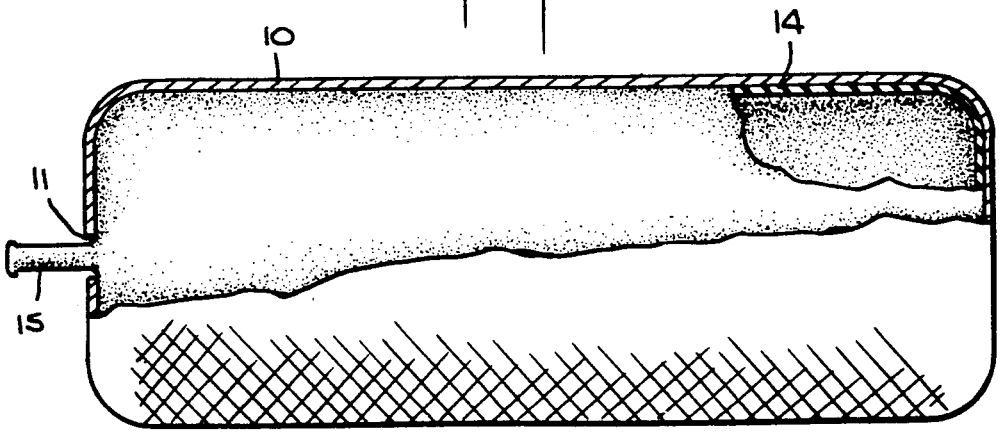
FIG. 3 shows the balloon included in the bolster.
Figure 5:
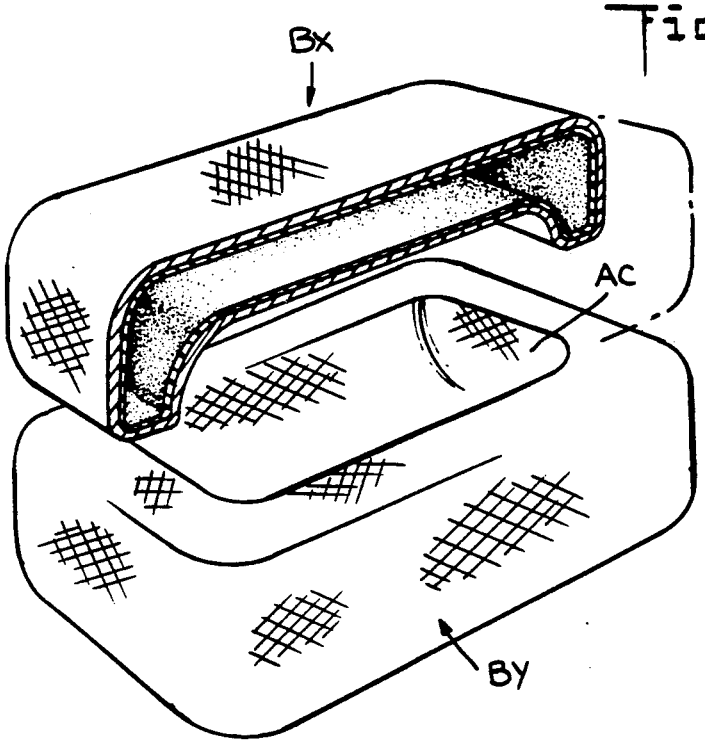
FIG. 5 shows bolsters used as protective cushioning in a package.

Referring now to FIGS. 1 to 3, there is shown a pneumatic bolster in accordance with the invention which is designed to protect the sides of a vessel or other vehicle such as a sled or wagon.

The bolster in this instance has a cylindrical cross section that is uniform through its length, and is composed of an outer, non-stretchable fabric casing 10 woven or otherwise fabricated of nylon, canvas or other high-strength material tailored to provide the desired bolster configuration. At one end of the casing is a small port 11 provided with a closure 12 which in practice may be a zipper fastener. Casing 10 is also provided with a rope handle 13 whose ends are sewn or otherwise attached to the casing. Thus the bolster may be suspended from a hook or cleat.

Inserted through open port 11 in its uninflated state is a rubber or latex balloon 14 having an air-passage stem 15 for mouth inflation, the stem then projecting out of the port. When the balloon is inflated, its skin more or less stretches to engage and conform to the inner surface of casing 10. Normally a balloon, when inflated, assumes a generally globular shape. But when the balloon is inflated within a non-stretchable contoured casing which is not globular but has a geometry dictated by its end use, the skin of the balloon, when it engages a surface of the casing, is then prevented from further stretching so that the skin is only free to stretch further in those regions not yet in engagement with the casing. Hence the degree to which various regions of the balloon skin are stretched within the casing depends on the casing configuration.

When the balloon is inflated to the point where the casing is fully expanded, stem 15 is then tied and pushed into port 11, after which it is closed by fastener 12. Now that the balloon is fully encased, the bolster has pneumatic properties determined by the internal pressure within the balloon. This pressure is relatively high, even though the balloon is mouth inflated, for the pressure must be such as to stretch the balloon skin to conform to the inner surface of the casing.

Despite the inherent weakness of a rubber balloon, because it is fully encased in the non-stretchable casing, the resultant bolster is capable of withstanding relatively heavy loads. A load imposed on the bolster seeks to compress the air in the balloon region underlying the load which in turn seeks to stretch the balloon in the region not subjected to the load. But because the casing is unstretchable, the balloon is not permitted to stretch beyond the confines of the casing. Hence the bursting strength of the bolster is determined primarily by the fabric characteristics, for the balloon is fully encased thereby and cannot be extruded from the casing. For heavy duty applications, the casing may be made of plastic film material such as Mylar, multi-ply high strength fabric, or resin-reinforced fabric.

Figure 4:
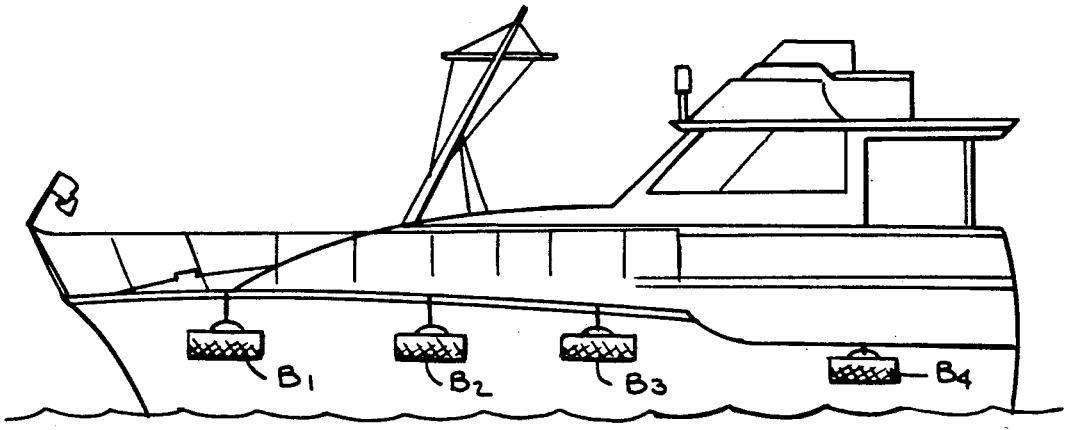
FIG. 4 shows a boat provided with bolsters in accordance with the invention.

These bolsters, as shown in FIG. 4, may be used on pleasure boats and other small vessels as cushions or pads to protect the sides of the hull when the boat is docked or being docked. Thus bolsters $B_1$, $B_2$ and $B_3$ are suspended from cleats secured to the gunwales on the topside of the deck on both the port and lee sides of the boat.

These bolsters, which are light-weight, are put in place on the cleats when the boat is to be docked, but otherwise may be stored below deck in their collapsed state so that they occupy little storage space. This is a significant advantage over conventional boat hull protectors which are relatively heavy and non-collapsible. The bolsters are also usable as life preservers should an emergency arise.

Packaging

While it is now commonplace in protective packaging to use rigid foam plastic slabs which are molded to conform to the object being packaged, in some instances the article to be protected may be very delicate and not adequately protected against shock by rigid foam plastic material.

Because a pneumatic cushion in accordance with the invention when used for protective packaging effectively floats the article on an air cushion, it provides a higher measure of protection.

Thus assuming that the article to be packaged is a precious object made of glass, the pneumatic cushion for this purpose is composed of a pair of complementary bolsters BX and BY which are contoured to create a cavity AC for accommodating the article to be packaged.

Bolsters BX and BY, apart from their difference in shape, are composed, as is the bolster shown in FIGS. 1 and 2, of an outer non-stretchable casing and an inner rubber balloon.

Apparel

Sports garments made of non-stretchable fabric material may be provided with zippered pockets adapted to receive inflatable balloons to form pneumatic cushions which serve a dual function.

Figure 6:
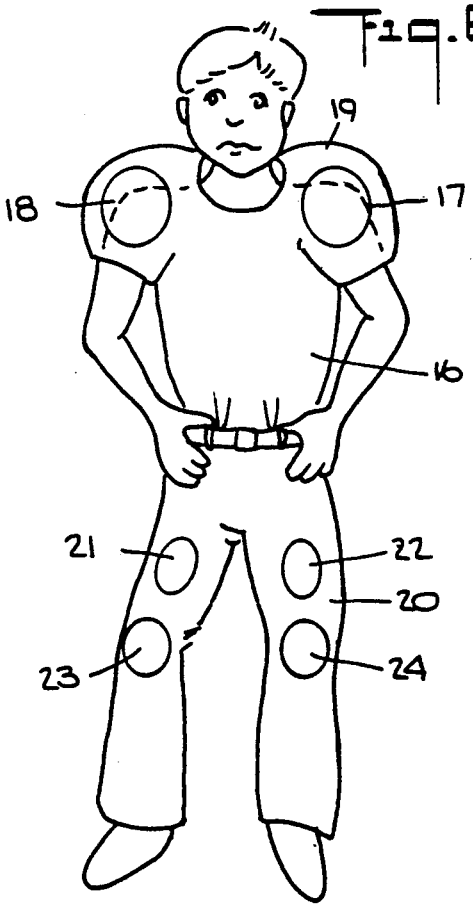
FIG. 6 shows in front view a boy wearing a shirt and trousers incorporating pneumatic cushions in accordance with the invention.
Figure 7:
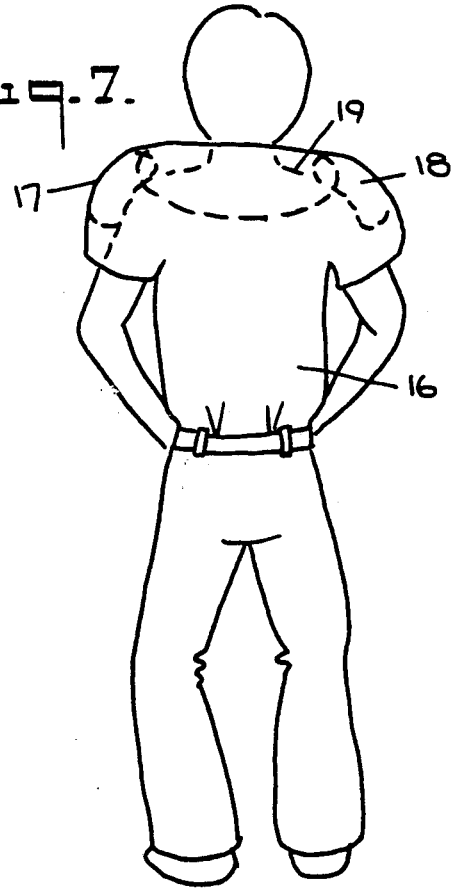
FIG. 7 is a rear view of the boy.

Their first function is to protect the player wearing the garment from injury, and the second function is to simulate at low cost a padded professional football or other sports uniform. Thus as shown in FIGS. 6 and 7 a short sleeved shirt 16 is provided with small shoulder pockets 17 and 18 and an elongated rear pocket 19 behind the neck, each pocket having a small closable opening adapted to receive a balloon which after inflation has its stem tied and pushed into the port which is then closed.

To provide knee protection, trousers 20 are provided with pockets 21 to 24 above and below the knee adapted to receive inflatable balloons.

The advantage of this arrangement is that after use, the balloons may be removed from the garment, and the garment cleaned in a standard washing machine in the usual manner. This is not possible with padded sports apparel which require special handling in cleaning procedures.

While there have been shown and described preferred embodiments of pneumatic bolsters in accordance with the invention, it will be appreciated that many changes and modifications may be made therein without, however, departing from the essential spirit thereof.

Thus the port need not be provided with mechanical closure means, such as a zipper or Velcro fastener. In practice, the port may-be in the form of a narrow slit that can be dilated to admit the rubber balloon. The slit will resume its normal form and thereby effectively close the port after the balloon has been inflated and its tied stem has been pushed into the port, the stem then abutting and blocking the slit.

Nor is it necessary that the bolsters have a cylindrical cross section as shown, for they may also have an oblong or another geometrical form.

The bolster may be configured to assume a U-shaped form with the arms of the U being curved toward each other to define an incomplete ring. In this form, it can serve as a pneumatic life preserver which is of particular value on small boats. In this context, should the boat have a passenger capacity of, say, six to eight passengers, there would be inadequate room to store a suitable number of conventional kapok life preservers, each of which occupies a fair amount of space. But with inflatable life preservers, these can be stored in the collapsed state in very little space.

I claim:

1. A pneumatic bolster or other pneumatic article having a predetermined end use comprising:

(a) an outer casing formed of non-stretchable flexible material having predetermined strength characteristics and having a closable port therein, said casing having a geometry dictated by the end use of the article and having a predetermined maximum dimension; and (b) a balloon formed of stretchable material having a relatively low bursting strength, said balloon being normally capable of being inflated to assume a globular form having a diameter which is greater than said casing dimension, said balloon being inserted in its uninflated state into the casing through the port and having an air-passage stem projecting out of the port, which after the balloon is inflated and stretched differentially to engage and conform to the inner surface of the non-stretchable casing, is sealed and pushed into the port which is then closed so that the balloon is then fully encased and is not permitted to stretch beyond the confines of the casing to provide a bolster having pneumatic properties, said bolster having a high bursting strength determined primarily by the strength characteristics of the casing material.

2. A bolster as set forth in claim 1, wherein said casing is provided with a handle.

3. A bolster as set forth in claim 1, wherein said bolster has a cylindrical cross section.

4. A pair of complementary bolsters as set forth in claim 1, each configured to define one half of a cavity accommodating an article to be protectively packaged.

5. A bolster as set forth in claim 1, incorporated in an article of apparel having at least one closable pocket therein to define said casing.

6. A bolster as set forth in claim 5, wherein said article of apparel is a T-shirt whose shoulders are each provided with said pocket.

7. A pneumatic bolster or other pneumatic article having a predetermined end use comprising:

(a) an outer casing formed of non-stretchable flexible fabric material having predetermined strength characteristics and having a closable port therein, said casing having a geometry dictated by the end use of the article and having a predetermined maximum dimension; and (b) a balloon formed of stretchable material having a relatively low bursting strength, said balloon being normally capable of being inflated to assume a globular form having a diameter which is greater than said casing dimension, said balloon being inserted in its uninflated state into the casing through the port whose dimensions are relatively small but sufficient to admit the balloon therein in its uninflated state, said balloon having an air-passage stem projecting out of the port, which after the balloon is inflated and stretched differentially to engage and conform to the inner surface of the non-stretchable casing, is sealed and pushed into the port so that the balloon is then fully encased and is not permitted to stretch beyond the confines of the casing to provide a bolster having pneumatic properties, said bolster having a high bursting strength determined primarily by the strength characteristics of the casing material.

* * * * *